US010087597B2

(12) United States Patent
Daoust et al.

(10) Patent No.: US 10,087,597 B2
(45) Date of Patent: Oct. 2, 2018

(54) CONCRETE WALL BLOCK

(71) Applicant: LES MATERIAUX DE CONSTRUCTION OLDCASTLE CANADA, INC., St-John (CA)

(72) Inventors: Robert Daoust, Boucherville (CA); Bertin Castonguay, Magog (CA); Tamara Evans, Montreal (CA); John Penterman, Montreal (CA)

(73) Assignee: LES MATERIAUX DE CONSTRUCTION OLDCASTLE CANADA, INC., St-John (CA)

( * ) Notice: Subject to any disclaimer, the term of this patent is extended or adjusted under 35 U.S.C. 154(b) by 0 days.

(21) Appl. No.: 14/971,507

(22) Filed: Dec. 16, 2015

(65) Prior Publication Data

US 2016/0177532 A1 Jun. 23, 2016

Related U.S. Application Data

(63) Continuation-in-part of application No. 13/332,971, filed on Dec. 21, 2011, now abandoned.

(Continued)

(51) Int. Cl.

| | |
|---|---|
| ***E02D 29/02*** | (2006.01) |
| ***E04C 1/39*** | (2006.01) |
| *E04B 2/02* | (2006.01) |

(52) U.S. Cl.

CPC ..... *E02D 29/025* (2013.01); *E02D 29/0266* (2013.01); *E04C 1/395* (2013.01);

(Continued)

(58) Field of Classification Search

CPC ... E04C 1/00; E04C 1/395; E04C 2/04; E04C 2/30; E04B 2002/0263; E04B 2002/0265;

(Continued)

(56) References Cited

U.S. PATENT DOCUMENTS 4,123,881 A 11/1978 Muse
4,825,619 A * 5/1989 Forsberg ..... E02D 29/025 405/286

(Continued)

FOREIGN PATENT DOCUMENTS

| | | |
|---|---|---|
| GB | 112084 | 12/1917 |
| WO | 2004070114 A2 | 8/2004 |
| WO | 2010024767 A1 | 3/2012 |

OTHER PUBLICATIONS

Mexican Patent Application No. MX/a/2013/006711 Office Action dated Oct. 12, 2016 and English translation.

(Continued)

*Primary Examiner* — Jessica L Laux

(74) *Attorney, Agent, or Firm* — Borden Ladner Gervais LLP; Louis B. Allard

(57) ABSTRACT

A stackable concrete wall block is disclosed having a body with an irregular front portion and a prism shaped rear portion, the irregular front portion has a three dimensional surface structure embossed in the front face providing the appearance of natural stone and the regular rear portion facilitating stacking of like blocks. The rear portion has parallel sidewalls perpendicular to a rear wall, which are more easily manufactured by dry casting than tapered sidewalls. A lip protrudes from at least one of the sidewalls of the rear portion and is coplanar with the front face for spacing the body of the block from that of a like block placed adjacent thereto. The lateral lip generates spacing between adjacent blocks at a back terminal edge, thereby allowing the assembly of curved walls. The irregular front face extends over the lip so that the front face is continuous over the lip.

13 Claims, 7 Drawing Sheets

Related U.S. Application Data

(60) Provisional application No. 61/425,407, filed on Dec. 21, 2010, provisional application No. 61/555,947, filed on Nov. 4, 2011.

(52) U.S. Cl.
CPC ..... *E04B 2002/0239* (2013.01); *E04B 2002/0263* (2013.01); *E04B 2002/0265* (2013.01); *E04B 2002/0269* (2013.01); *E04B 2002/0271* (2013.01)

(58) Field of Classification Search
CPC ..... E04B 2002/0267; E04B 2002/0269; E04B 2002/0271; E04B 2002/0239
See application file for complete search history.

(56) References Cited

U.S. PATENT DOCUMENTS

| | | | | |
|---|---|---|---|---|
| 4,826,519 | A | 5/1989 | Forsberg | |
| 5,044,834 | A | 9/1991 | Janopaul, Jr. | |
| 5,425,600 | A * | 6/1995 | Gordon | E02D 29/025 405/125 |
| 5,735,643 | A | 4/1998 | Castonguay et al. | |
| 5,788,423 | A | 8/1998 | Perkins | |
| 5,878,545 | A | 3/1999 | Gebhart | |
| 6,615,561 | B2 | 9/2003 | MacDonald et al. | |
| 6,821,058 | B1 | 11/2004 | Dawson | |
| 7,073,304 | B2 | 7/2006 | Hampton et al. | |
| 7,090,438 | B2 | 8/2006 | Price et al. | |
| 7,448,830 | B2 | 11/2008 | MacDonald et al. | |
| 7,654,776 | B2 | 2/2010 | MacDonald et al. | |
| 7,871,223 | B2 | 1/2011 | MacDonald et al. | |
| 8,201,376 | B2 * | 6/2012 | Witcher | E04C 1/395 52/565 |
| 2002/0187010 | A1 | 12/2002 | MacDonald et al. | |
| 2004/0159065 | A1 | 8/2004 | Burgess et al. | |
| 2005/0241257 | A1 | 11/2005 | Price | |
| 2005/0279046 | A1 | 12/2005 | Gravier et al. | |
| 2006/0179780 | A1 | 8/2006 | Price | |
| 2006/0265991 | A1 | 11/2006 | Gu | |
| 2007/0144099 | A1 | 6/2007 | Price | |
| 2007/0289247 | A1 * | 12/2007 | Hamel | B28B 7/007 52/596 |
| 2007/0292216 | A1 | 12/2007 | Hamel | |
| 2008/0307740 | A1 | 12/2008 | MacDonald | |
| 2008/0313988 | A1 | 12/2008 | MacDonald | |
| 2009/0049788 | A1 | 2/2009 | Thorpe | |
| 2011/0047920 | A1 | 3/2011 | Garrett | |
| 2012/0023857 | A1 * | 2/2012 | Bergmann | B28B 7/183 52/605 |

OTHER PUBLICATIONS

International Preliminary Report on Patentability for Application No. PCT/CA2011/050796, dated Jun. 25, 2013, 4 pages.
Office Action dated Jun. 6, 2016 for AU Application No. 20110348981 filed Dec. 21, 2011.
Supplementary European Search Report for Application No. EP11851695, dated Dec. 2, 2015, 7 Pages.
Australian Patent Application No. 20110348981, Examination Report dated Feb. 17, 2017.
Canadian Patent Application No. 2,816,643, Notice of Allowance dated Jun. 19, 2015.
Canadian Patent Application No. 2,816,643, Office Action dated Aug. 5, 2014.
International Patent Application No. PCT/CA2011/050796, International Search Report and Written Opinion dated Mar. 20, 2012.
European Application No. 11851695.4, Extended European Search Report dated Dec. 2, 2015.
European Patent Application No. 11851695, Communication pursuant to Article 94(3) EPC dated Jan. 23, 2018.

* cited by examiner

CONCRETE WALL BLOCK

CROSS REFERENCE TO RELATED APPLICATIONS

This application is a continuation in part application of U.S. application Ser. No. 13/332,971 filed Dec. 21, 2011 and entitled Concrete Wall Block, which claims the benefit of priority of U.S. Provisional Patent Application No. 61/425,407 filed Dec. 21, 2010 and U.S. Provisional Patent Application No. 61/555,947 filed Nov. 4, 2011, the contents of which are incorporated herein by reference in their entirety.

FIELD OF THE INVENTION

The invention relates to concrete blocks, such as wet cast or dry cast concrete blocks for use in the creation of walls, including blocks having an embossed front face. More particularly, the invention relates to concrete blocks with natural stone appearance for use in the creation of curved walls, such as retaining walls.

BACKGROUND ART

Retaining walls or freestanding walls can be made of natural stone, such as quarried stone. However, due to the irregular shape and size of natural stone or quarried stone, significant time and skill is required in erecting a wall from natural stone. The assembly of a curved natural stone wall is particularly difficult. Using quarried stone of ashlar dimensions facilitates the assembly of a natural stone retaining wall, but still requires significant time and skill, unless the stones are all cut to common dimensions, to allow the stones to be stacked in regular rows. Trimming natural stones to allow for the assembly of a curved wall is particularly time consuming and costly.

The use of artificial blocks made of concrete has greatly facilitated the assembly of retaining walls, but the appearance of such walls is very even and in general less appealing than that of a natural stone wall. Split concrete blocks and surface treated concrete blocks have been used to simulate the appearance of natural stone, but are still easily distinguished from natural stone walls.

Artificial facing panels and paving stones with an appearance resembling natural stone, such as ledgestone, fieldstone or quarried rock are known in the art. Natural stone, in particular chipped or broken stone, such as quarried stone, has recognizable appearance characteristics. Generally, natural stone includes at least one facing surface with randomly dispersed projections, depressions, crevices, cracks and the like. Moreover, the natural appearance of the stone is further caused by the irregularity of the broken outer edge, contour, or periphery of that facing surface. Facing panels for adhesive application to an existing wall structure and having the appearance of natural stone are shown in U.S. Pat. No. 5,535,563. A cast paving stone having an upper part with a surface structure simulating the appearance of natural stone is disclosed in U.S. Pat. No. 4,627,764. EP 0666372 discloses a concrete paving stone with a facing surface having embossed therein the desired visual impression of natural stone. The face of the concrete block disclosed in EP 0666372 is formed with an irregular edge and the side surfaces have an irregularly corrugated profile. The front surface or face surface is cast to resemble natural stone such as ledgestone.

Concrete blocks are known for the use in landscaping applications, particularly for retaining walls. Various different block configurations or shapes are known. To allow the assembly of curved walls, concrete retaining wall blocks are usually provided with a rearwardly tapered body with sidewalls that are at an angle of less than 90 degrees to the front face of the block. Stacking such blocks side by side with the angled sidewalls of adjacent blocks engaging one another results in a convexly curved wall. Concave curvatures are obtained by stacking the blocks side by side with the front edges touching, while the tapered rear ends are spaced apart. This provides significant flexibility in the creation of curved walls the radius of curvature of the wall being limited solely by the angle of the sidewalls relative to the front face. However, tapered blocks and walls built with such blocks have several drawbacks. Curved walls with a radius of curvature smaller than the minimum radius set by the angle of the sidewall taper will have gaps in the front face. Moreover, molding dry cast tapered blocks with converging sidewalls and an embossed front face is challenging due to the need for stripping the compressed block from the mold.

Dry casting uses a no slope concrete mixture which is filled into a mold cavity and compressed to sufficiently pre-consolidate the block to permit handling of the block prior to curing of the concrete mixture. After pre-consolidation, the block is stripped from the mold and transported to a curing station for curing of the concrete mixture. Stripping of the block is achieved by pushing it out of the mold with a stripper shoe which has a dual function. The stripper shoe is used during pre-consolidation to compress the dry cast concrete mixture. After pre-consolidation, the stripper shoe is used for forcing the pre-consolidated block from the mold. To produce blocks with an embossed surface structure or pattern on the front face, the stripper shoe is provided on its dry cast mixture engaging face with a negative of the three-dimensional surface structure to be produced on the block face during pre-consolidation.

Stripping the pre-consolidated block by pushing it from the mold requires a clear path for the block through the mold, which mandates the use of movable mold walls in the manufacture of tapered, embossed blocks. To facilitate handling and stacking of pre-consolidated embossed blocks and especially to minimize damage to the embossed front face during curing, the embossed blocks are usually manufactured with the front and rear faces oriented up and down in the mold, respectively. That means the sidewalls of the mold must be movable from the angled position required for the shaping of the tapered shape of the block, in order to provide a clear path of the block through the mold. Thus, embossed wall blocks for the assembly of curved walls are desired which are more easily manufactured.

It is now an object of the invention to overcome at least one of the disadvantages associated with known dry cast embossed wall blocks.

SUMMARY OF THE INVENTION

In a preferred embodiment, the invention provides a stackable, dry cast, concrete retaining wall block including a body having a front portion and a rear portion and front and rear terminal edges respectively at the front and rear portion for engagement of a like block placed side by side to the retaining wall block. The front portion includes a front face with an irregular peripheral edge and a multifaceted depending sidewall, the front face having a three-dimensional surface structure of projections, depressions, or crevices embossed into the front face and the multifaceted sidewall following the irregular peripheral edge, providing the front portion the visual appearance of a natural stone face. The rear portion has parallel top and bottom planar faces for placement opposite like blocks located above or below in a stacked condition of the retaining wall block, a planar rear face perpendicular to the top and bottom faces and a pair of planar and parallel side walls perpendicular to the rear face. The front and rear terminal edges are located at the front portion and the rear face respectively and the front portion includes a lip protruding laterally beyond at least one of the side walls of the rear portion for placing the front terminal edge further outward than the rear terminal edge in a direction parallel to the rear face.

This orients the block at an angle to the adjacent like block when the front and rear terminal edges are in engagement with the like block. In the preferred embodiment, the front face extends over the lip and the lip has a rear wall parallel to the rear face.

In another embodiment, the wall block includes a pair of opposite lateral lips.

Each lip in the wall block has a depth which is at the maximum 50% of the overall depth of the wall block as measured from the front face to the back face. Preferably, the lip has a depth between 5% and 50% of the overall depth, more preferably between 25% and 50% of the overall depth.

To reduce the risk of breaking or slumping of the lip, the lip may have one or more steps in the rear wall, thereby reducing the overhang of each step relative to a single lip without step. The outermost step of the lip is thereby of the highest depth and smallest overhang of all steps and the depth of the lip increases with each step from the front face edge towards the rear portion. In one embodiment, the lip includes a first step and at least one subsequent step, the first step being the outermost step and having a larger depth and smaller overhang than each subsequent step.

The three-dimensional surface structure of the front face may include at least one false joint which may be oriented at an angle of 0 to 45 degrees to the top or bottom face.

The front face includes a top edge and a bottom edge respectively oriented towards like blocks stackable above or below the wall block and lateral edges oriented towards like blocks stackable side by side with the wall block. At least one of the lateral edges may be oriented at an angle of 45 to 90 degrees to the top or bottom edge.

The side walls of the rear portion may be oriented at an angle of 90 to 45 degrees to the bottom face.

In a further embodiment, the wall block includes a pair of opposite lateral lips, the front face includes a top edge and a bottom edge respectively oriented towards like blocks stackable above or below the wall block and lateral edges oriented towards like blocks stackable side by side with the wall block, at least one of the lateral edges being oriented at an angle of 45 to 90 degrees to the top or bottom edge, and the rear portion has side walls oriented at an angle of 45 to 90 degrees to the bottom face.

The lip may be a multistep lip and a depth of the lip may increase with each step from the front face to the rear portion.

The lip is preferably provided on both sides of the front portion to create lateral spacing at the rear portion between like concrete blocks stacked side by side in a wall, while providing the wall with a continuous front. As is the case with tapered blocks, this spacing at the rear allows the assembly of curved walls without significant gaps in the front of the wall. However, a prism shaped block with sidewalls perpendicular to the rear face and a laterally protruding lip is more easily manufactured than a tapered block with angled side walls, since no movable mold walls are required, when the block is made by dry casting. In a dry cast block, the lip can be achieved by way of a draw plate which is placed in the mold for filling and compression of the dry cast mixture and is pulled from the mold cavity prior to stripping. The use of draw plates in the manufacture of dry cast concrete blocks is known, but is generally used for the production of three-dimensional structures and/or undercuts in the rear face of the block.

In still another embodiment, the dry cast concrete wall block further includes a connecting structure for connection of a secondary structure, such as a setback pin, a like concrete block, or a veneer block to the rear face of the rear portion.

BRIEF DESCRIPTION OF THE DRAWINGS

The invention will now be further described by way of exemplary embodiments and with reference to the attached drawings, wherein.

DETAILED DESCRIPTION

The present application is directed to a wall block for the assembly of a retaining wall, preferably a dry cast concrete block with a front portion having the visual appearance of natural stone face and a rear portion in the shape of a prism for easy and stable stacking of the stone with like stones into a wall, the front face having an embossed three dimensional surface structure.

Figure 1A:
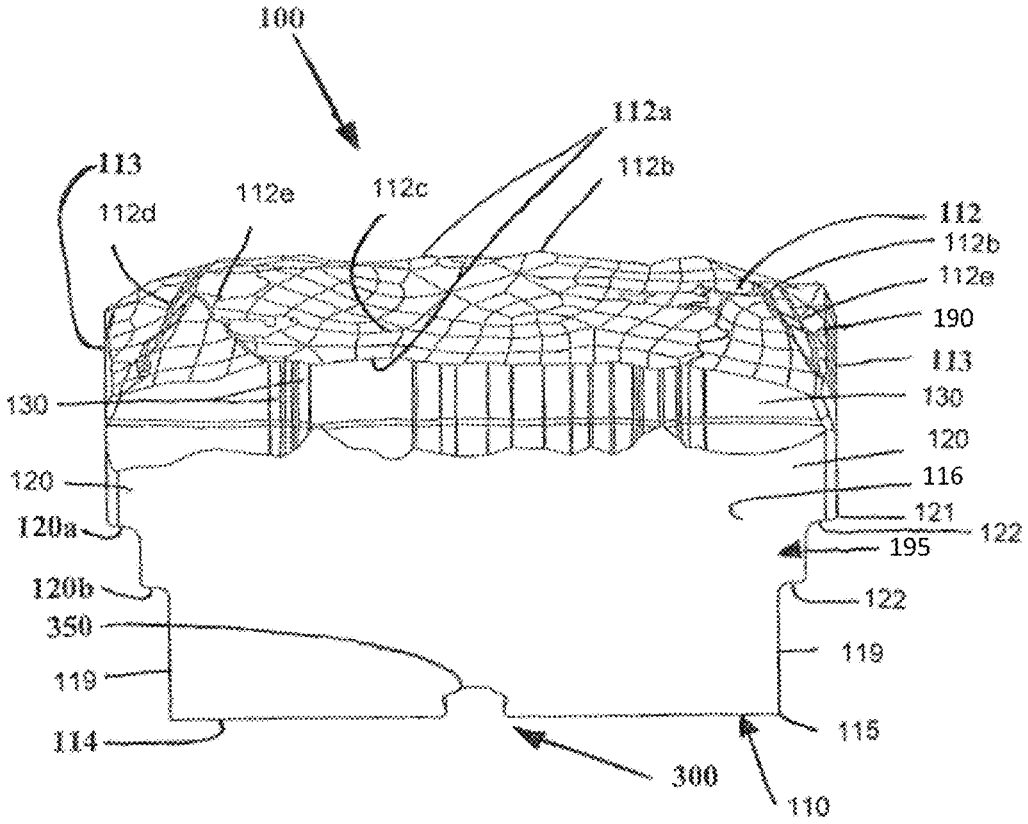
FIG. 1*a* to 1*d* are perspective, bottom plan, front plan and end elevation views of a wall block with a stepped lip.
Figure 1B:
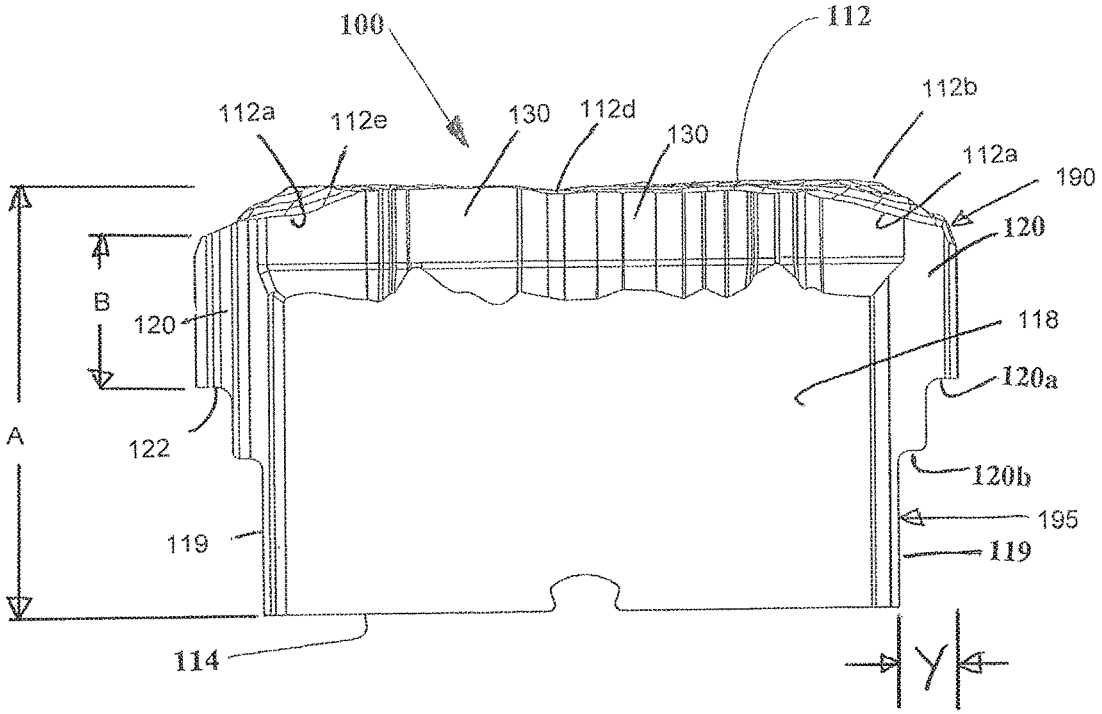
Figure 1C:
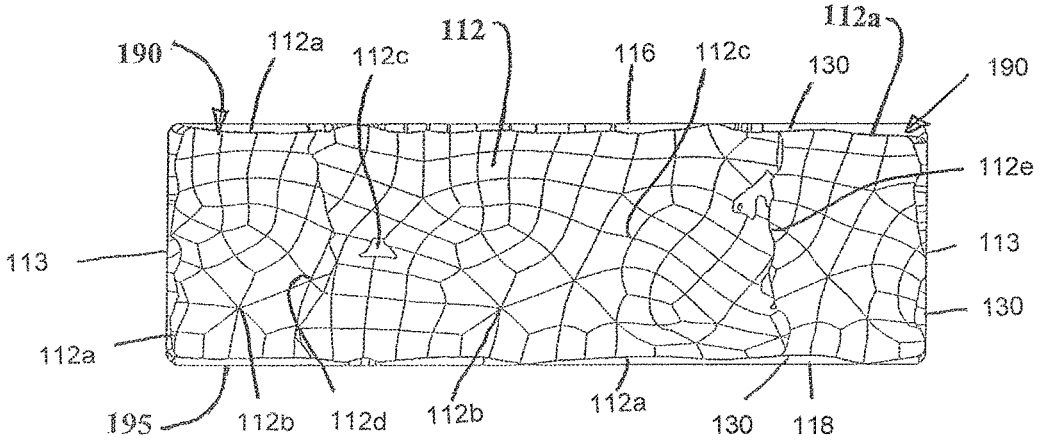
Figure 1D:
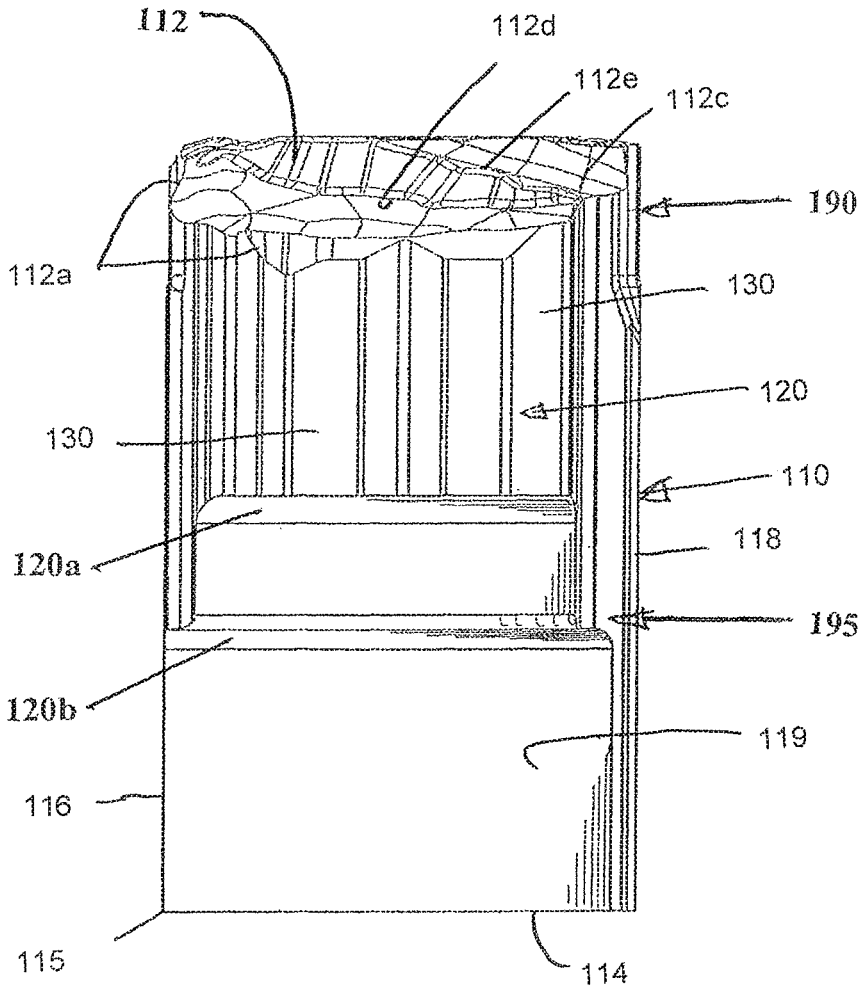
Figure 2:
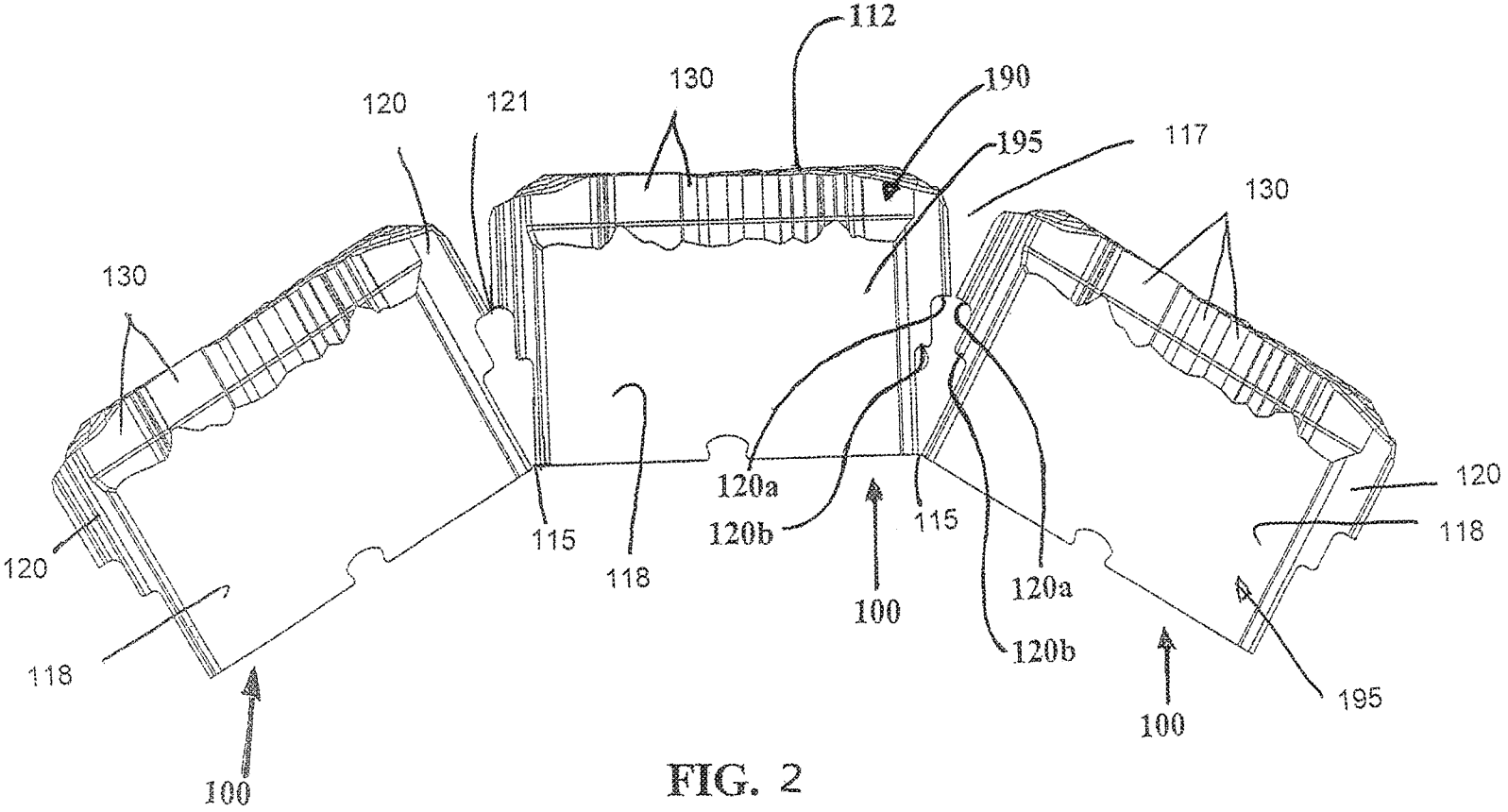
FIG. 2 is a schematic illustration of a curved wall assembled with the wall blocks of FIGS. 1*a* to 1*d;*
Figure 4:
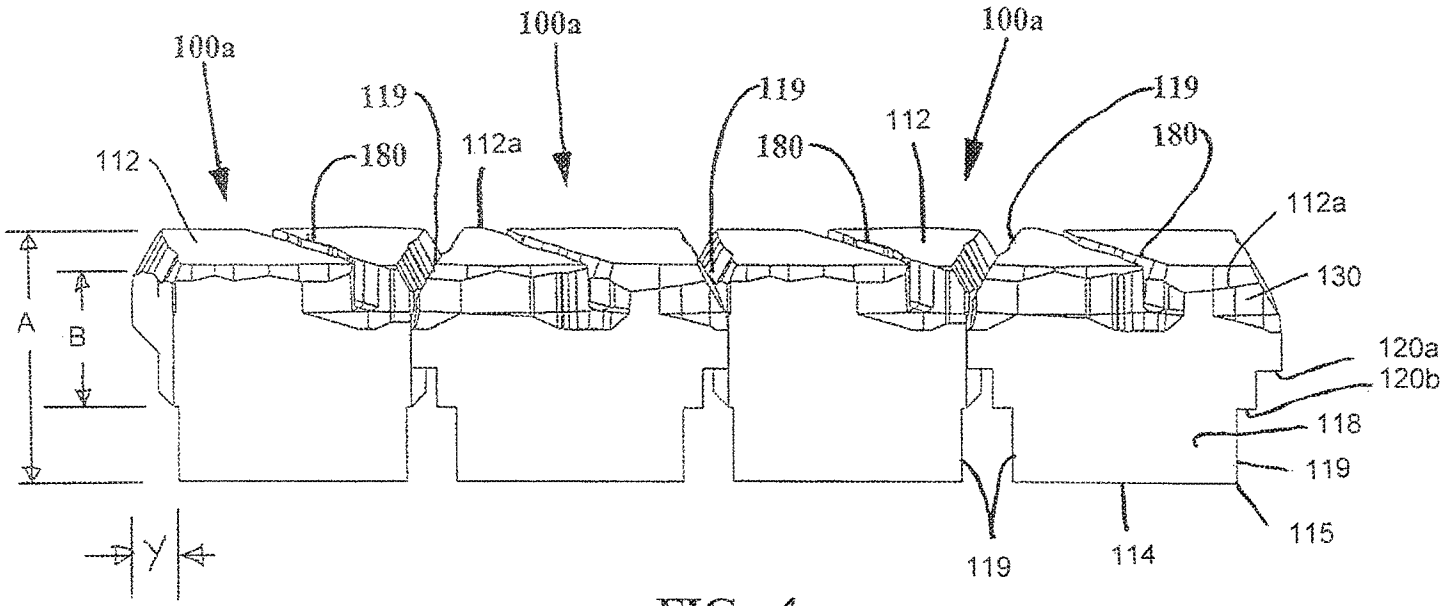
FIG. 4 is an elevational view of the first row of blocks of the partial wall shown in FIGS. 3*a* and 3*b*.

In a preferred embodiment as schematically illustrated in FIGS. 1*a* to 1*d* and FIG. 2, the wall block 100 includes, a body 110 with a front face 112, a rear face 114, top and bottom faces 116 and 118 and generally parallel side walls 119. The wall block 100 further includes at least one laterally protruding lip 120 on at least one of the side walls 119, which lip 120 protrudes from the side wall 119 and is coplanar with the front face 112, which means the front face 112 extends over the lip 120. The lip 120 can be provided on either one or both of sides of the block 100. The spacing created by the lips 120 allows the assembly of straight walls as shown in FIG. 4 or curved walls as shown in FIG. 2, by arranging the wall blocks in such a way that terminal edges of the block at the lip 120 and the rear face 114 touch the respective edges of an adjacent wall block. The protruding length of the lips 120 determines the radius of curvature which can be achieved by placement of the wall blocks 100 side by side in wall with the lips 120 and the bodies 110 of adjacent blocks touching as shown in FIG. 2. The larger the protruding width of the lips, the smaller the minimum radius achievable. Moreover, the shorter the length of the wall block 100, the smaller the minimum radius achievable.

Figure 3A:
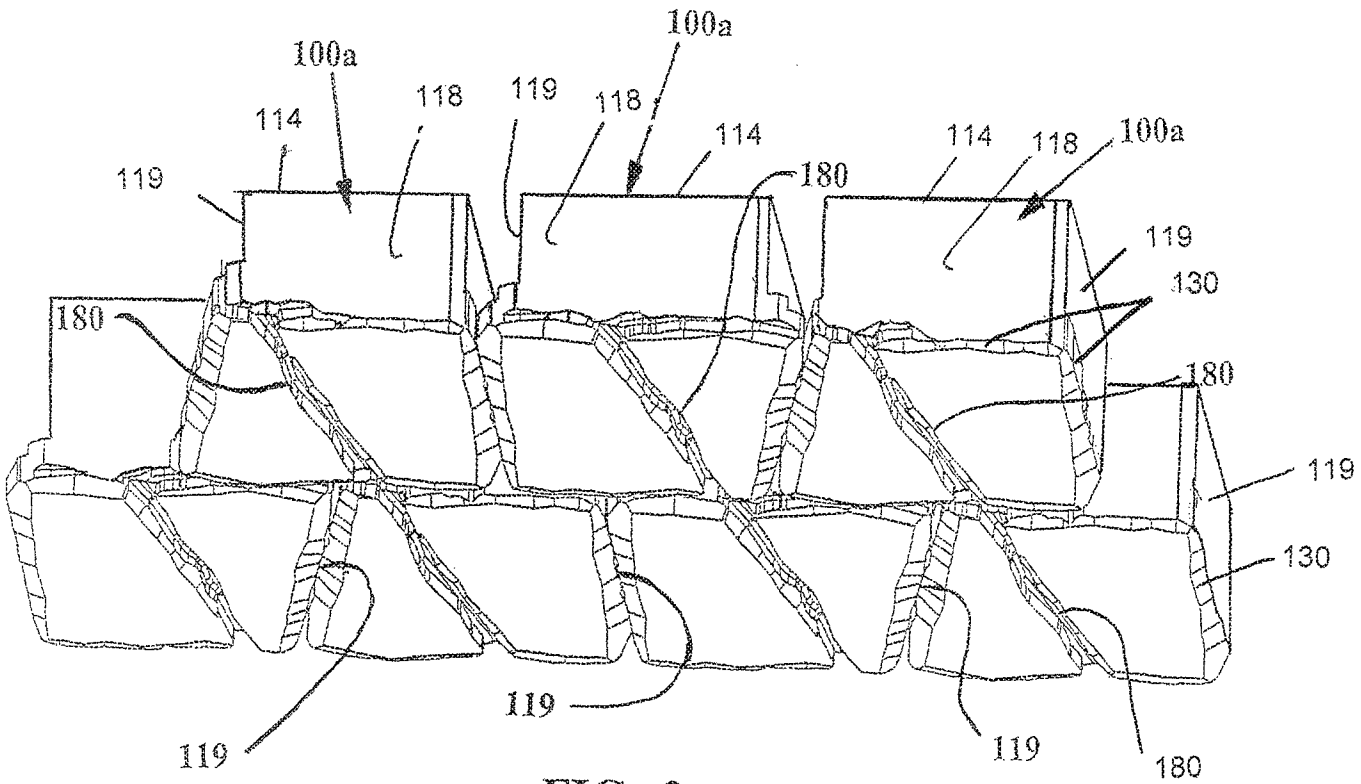
FIGS. 3*a* and 3*b* are a front and top perspective view and a front plan view of a partial wall including seven (7) stacked blocks in accordance with a variant embodiment of the invention.
Figure 3B:
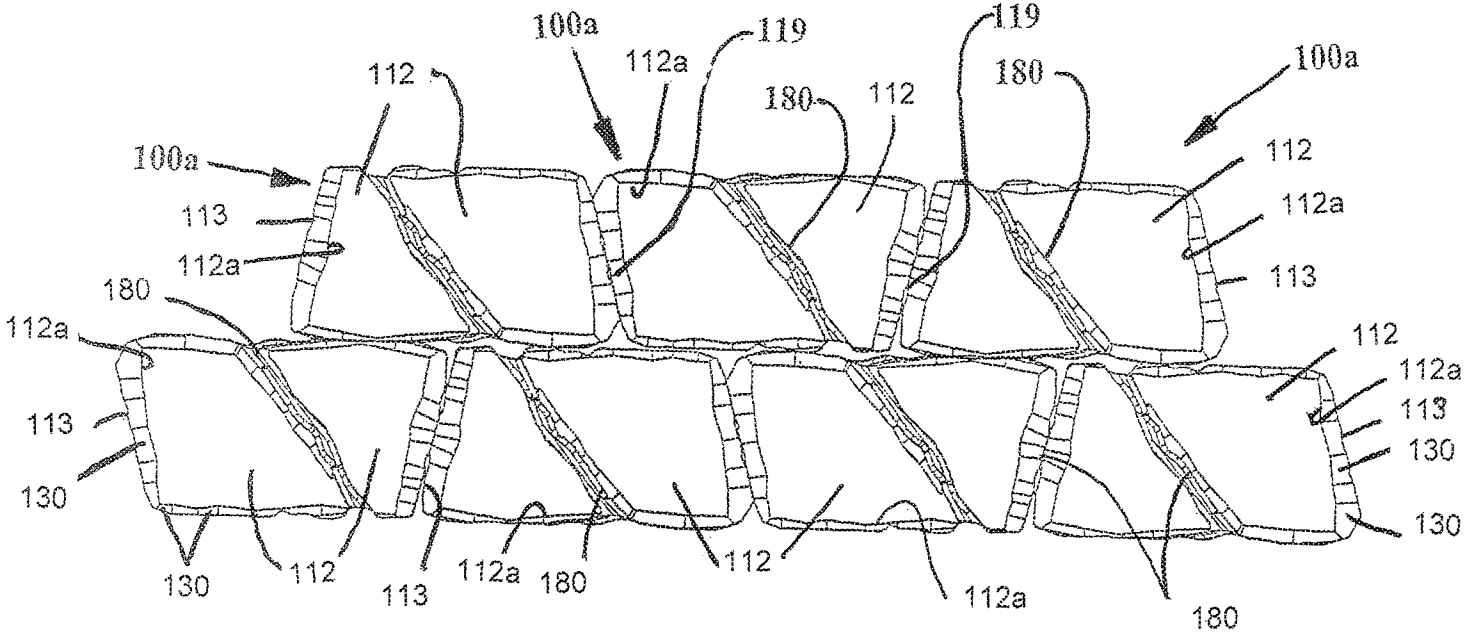

In the installed condition of the wall block 100, wherein the wall block 100 is stacked with like wall blocks 100 into a wall, the lip 120 provides for spacing between the bodies 110 of adjacent wall blocks 100 placed side by side, while providing the resulting wall with a continuous front surface, as shown in FIG. 3*b*. The front face 112 of the block, which extends over the lip 120, has an embossed three-dimensional surface structure. Preferably the front face 112 is embossed with a surface structure, which provides the wall block 100 and any wall assembled with such wall blocks with the appearance of natural stone as is apparent from FIG. 3*b*.

The lip 120 can be provided on either one or both of the side walls 119, preferably both, to create bi-lateral spacing between the bodies 110 of wall blocks 100 stacked side by side in a straight wall (see FIG. 4), while providing the wall with a continuous front surface. As is the case with tapered blocks, this spacing allows the assembly of curved walls, by arranging the wall blocks in such a way that terminal edges of the front and rear faces 112, 114 of adjacent wall blocks 100 are in engagement (see FIG. 2).

A wall block 100 with a body 110 with parallel top and bottom faces parallel side walls 119 is more easily manufactured by dry casting than known, tapered blocks, since no movable mold walls are required.

In another preferred embodiment as illustrated in the Figures, the dry cast wall block 100 further includes a connecting structure 300 for connection of a secondary structure to the rear face 114 of the wall block 100. The secondary structure can be a setback pin, a like block, a different block, or a veneer. The connecting structure 300 includes at least one of a pair of interconnecting protruding and recessed elements, most preferably in the shape of a dovetail arrangement, one of the elements being incorporated into the rear face 114 of the wall block 100 and the other one into the secondary structure (not shown). The connecting structure may include multiple alternating protruding and recessed elements (not shown) in the shape of a repeated dovetail arrangement.

The protruding length Y of the lips 120 determines the radius of curvature which can be achieved by placement of the wall blocks 100 side by side in a wall with the lips 120 and the bodies 110 of adjacent blocks 100 being in engagement. The larger the protruding width Y, the smaller the minimum radius achievable. An angle a is enclosed by the side wall 119 of the wall block 100 and an imaginary line 400 connecting the free end 121 of the protruding lip 120 with the terminal edge 115 of the rear wall 114. This angle is the minimum angle at which adjacent wall blocks can be placed without forming a gap between the blocks at the front face 112. Of course, wall blocks 100 can also be placed side by side in straight alignment to form a straight wall, in which case the protruding lips 120 are in engagement, but the blocks do not touch at the rear face 114, resulting in a space between adjacent wall blocks 100 at the rear face 114. To achieve a curved wall, the wall blocks 100 are placed side by side with the lips 120 in engagement, while the lateral edges 115 of the rear faces 114 are placed closer to one another as in the straight orientation. In a curved wall of minimum radius, the lateral edges 115 of the rear faces 114 of adjacent blocks 100 are in engagement and the blocks are placed at the angle a relative to one another (see FIG. 2).

Casting of the lip 120 can be achieved by way of a draw plate (not shown), which is placed in a mold for the wall block (not shown). The draw plate is left in the mold for the filling of the mold and compression of the dry cast mixture in the mold and is pulled from the mold cavity prior to stripping of the block. The use of draw plates in the manufacture of dry cast concrete blocks is known.

The lip 120 preferably has a depth B, measured in a direction parallel to the associated side wall 119, which is a maximum of 50%, preferably between 50% and 5%, most preferably between 50% and 25% of the overall depth A of the wall block 100 as measured from the front face 112 to the back face 114 (see FIGS. 1*b* and 4). The larger the depth of the lip 120, the wider a gap 117 between the front faces 112 of adjacent stacked blocks 100 in a curved wall (see FIG. 2). Thus, in order to minimize the gap 117, it would be preferable to minimize the depth of the lip 120. Yet, the smaller the depth of the lip 120, the harder it is to manufacture the block 100 by dry casting, since the lip 120 may brake or sag during or after demolding and prior to complete setting of the block. Moreover, the minimum radius achievable with stacked blocks 100 including the lip 120 is determined by the protruding length Y, or overhang, of the lip 120, which is the distance the lip 120 protrudes laterally outward from the sidewall 119 of the block 100 (see FIGS. 1*b* and 4). The larger the overhang created by the lip 120, the smaller the minimum radius achievable. However, the larger the overhang, the higher the risk of the lip 120 braking or sagging during or after demolding. Consequently, the range of radii achievable by adding a single lip 120 on each side of the block 100 is limited.

In order to address these limitations in relation to the depth and overhang of the lip, the invention also provides a variant of the block 100 in which a larger total protruding length Y or overhang is achieved by providing a stepped lip 120 including two or more steps 120*a*, 120*b*, as illustrated in FIGS. 1*a* to 1*d*. By dividing the total protruding length or overhang of the lip 120 into multiple, staggered steps 120*a*, 120*b*, the chance of the lip braking or sagging during or after demolding is much reduced. Each step 120*a*, 120*b* is defined by perpendicular walls respectively parallel to the sidewall 119 and the rear face 114 of the block 100. The protruding length of each step is preferably the same and equal to the total protruding length of the lip divided by the number of steps. The outermost step is coplanar with the front face. Any additional step is located further back towards the rear face 114 and provides a setback or undercut, so that the overall width of the block becomes progressively more narrow with each additional step. By providing the lip with multiple steps, the danger of braking or sagging of the lip during or after demolding is significantly reduced, since the tendency of the lip to brake or sag then becomes directly dependent on the protruding length of the largest step, rather than the overall protruding length of the lip. Since the potential of the lip braking or sagging during or after demolding also directly depends on the depth of the lip, the depth of the outermost step adjacent the front face 112 is preferably larger than the depth of any subsequent step. Moreover, the protruding length of the outermost step is preferably smaller than the protruding length of any subsequent step. When two steps are provided, the protruding length or overhang of the outermost step is preferably less than half the protruding length of the subsequent step.

As illustrated in FIG. 1*a*, the block 100 in one embodiment includes an irregularly shaped front portion 190 with the simulated appearance of natural stone and a regularly shaped rear portion 195 in the shape of a prism for reliable and easy stacking of the block with like blocks. The front portion includes the embossed front face 112 with an irregular peripheral edge 112*a* with lateral edges 113 and a multifaceted depending sidewall 130 following the irregular peripheral edge 112*a*, which provides the front portion 190 with an irregularly shaped face and outline or contour, to simulate the appearance of a natural rock face. The front face has a three-dimensional surface structure of projections 112*b*, depressions 112*c*, or crevices 112*d*, or ridges 112*e* embossed into the front face. The multifaceted depending sidewall 130 follows the irregular peripheral edge 112*a*, providing the front portion the visual appearance of a natural stone face. The rear portion 195 is in the shape of a prism having planar top and bottom faces 116, 118 parallel to one another for placement opposite like blocks located above or below in a stacked condition of the retaining wall block. The rear portion 195 further includes a planar rear face 114 perpendicular to the top and bottom faces 116, 118 and a pair of parallel planar side walls 119 perpendicular to the rear face 114. The front and rear terminal edges 121, 115 are located at the front portion 190 and the rear face 114 respectively. The front portion 190 includes a lip 120 protruding laterally beyond, and extending outward from, at least one of the side walls 119 of the rear portion 195 for placing the front terminal edge 121 further outward than the rear terminal edge 115 in a direction parallel to the rear face 114, thereby orienting the block at an angle to the adjacent like block when the front and rear terminal edges are in engagement with the like block (see FIG. 2). The front face 112 extends over the lip 120 and the lip has a rear wall 122 parallel to the rear face 114.

The block of FIG. 10*a* further includes an interconnecting structure 300 for the connection of a secondary structure (not shown), such as a setback pin, a like concrete block, a veneer block, or a filler block, to the rear face 114 of the concrete block. The connecting structure is preferably a dovetail type connection with one or more female connector members 350 provided in the back face 114 of the wall block and a corresponding number of complementary male connector members (not shown) provided on, or connected with the secondary structure to be connected to the back surface 114. A back to back attachment of a pair of like blocks by way of the interconnecting structure 300 allows for the assembly of a two sided wall. The connecting structure may be a separate connector (not shown) insertable into the connector member 350 and a receiving recess in the secondary structure (not shown).

As shown in FIGS. 1*a* to 1*d* and 2, a facing surface 112 resembling a rock face or quarry face is produced by embossing the facing surface during dry casting of the stone with a three-dimensional surface structure including randomly dispersed projections 112*b*, depressions 112*c*, crevices 112*d*, ridges 112*e*, or the like to mimic the appearance of natural stone. Furthermore, the facing surface has an irregular contour, periphery or outer edge 112*a*, with a depending multifaceted sidewall 130, which imparts the front portion the visual appearance of a natural stone face.

In another embodiment of the block 100, illustrated in FIGS. 3*a*, 3*b* and 4 as block 100*a*, the block is provided with an embossed front face 112, which includes at least one crevice, here a false joint 180, which may extend at an angle to the top and bottom faces 116, 118. This makes the appearance of the block even more similar to the appearance of a natural stone, for example a quarry stone with ashlar dimensions. In the particular embodiment illustrated, the crevice 112*d* or false joint 180 extends at an angle of about 45 degrees to the top and bottom faces, but other orientations of the false joint 180 at any angle from 0 to 45 degrees are possible. Of course, the front face 112 may include multiple false joints 180 respectively oriented at different angles to the top and bottom faces 116, 118.

As illustrated in FIGS. 3*a*, 3*b* and 4, the block 100 or 100*a* can also be provided with irregularly shaped front faces 112 where at least one lateral edge 113 of the front face extends at an angle of up to 45 degrees to the sidewall 119. Thus, in this embodiment of the block, the lateral edges 113 of the front face are oriented at an angle of 0 to 45 degrees to the sidewall in order to give the block the appearance of a natural stone with slanted sidewalls. The sidewalls 119 can also be oriented at an angle other than perpendicular to the top and bottom faces 116, 118, for example at an angle of 70 to 110 degrees to the top or bottom face. However, if maximum structural stability of a wall of stacked blocks 100*a* is desired, it is preferred that the angled sides of the block be limited to only the front portion 190 of the block, with the rear portion 195 of the block having parallel sidewalls 119 perpendicular to the top and bottom faces 116, 118.

As shown in FIG. 2, the blocks 100 with multiple steps 120*a*, 120*b* can also be used to build a curved wall, whereby the radius of the curvature achievable is determined by the combined protruding length of all the lips 120*a*, 120*b* at each end of the block.

What is claimed is:

1. A stackable, dry cast, concrete retaining wall block, comprising a body having a front portion and a rear portion and front and rear terminal edges respectively at the front and rear portion for engagement of a like block placed side by side to the retaining wall block;

the rear portion being a prism shaped portion having planar top and bottom faces parallel to one another for placement opposite like blocks located above or below in a stacked condition of the retaining wall block, a planar rear face perpendicularly connecting to the top and bottom faces and two parallel planar side walls extending directly from and perpendicular to the rear face;

the front portion including a front face and a continuous multifaceted depending sidewall, the front face having an irregular peripheral edge and a three-dimensional surface structure of projections, depressions, or crevices in the front face, the multifaceted depending sidewall extending from the irregular peripheral edge and connecting to the rear portion and to at least to one of the top face and the bottom face of the rear portion, to provide the front portion the visual appearance of a natural stone face;

the front and rear terminal edges being located at the front portion and the rear face respectively; and the rear portion including a lip protruding laterally beyond and extending directly laterally outward from at least one of the two parallel planar side walls of the rear portion for placing the front terminal edge further outward than the rear terminal edge in a direction parallel to the rear face, thereby orienting the block at an angle to the adjacent like block when the front and rear terminal edges are in engagement with the like block, the front face extending over the lip and the lip having a rear wall extending from the at least one of the planar side walls and parallel to the rear face.

2. The wall block of claim 1, wherein:

the lip is a first lip protruding laterally beyond and extending outward from one of the two parallel planar sidewalls, and the rear portion includes a second lip that protrudes laterally beyond and extends directly laterally outward from the other of the two parallel planar sidewalls.

3. The wall block of claim 2, wherein the irregular peripheral edge of the front face includes a top edge and a bottom edge respectively oriented towards like blocks stackable above or below the wall block and lateral edges oriented towards like blocks stackable side by side with the wall block, at least one of the lateral edges being oriented at an angle of 45 to 90 degrees to the top or bottom edge and the parallel planar side walls of the rear portion being oriented at an angle of 70 to 110 degrees to the bottom face.

4. The wall block of claim 1, wherein the lip has a depth, which is at the maximum 50% of the overall depth of the wall block as measured from the front face to the back face.

5. The wall block of claim 4, wherein the lip has a depth between 5% and 50% of the overall depth.

6. The wall block of claim 5, wherein the lip has a depth between 25% and 50% of the overall depth.

7. The wall block of claim 1, wherein the lip has at least one step in the rear wall and a depth of the lip increases with each step from the front face edge towards the rear portion.

8. The wall block of claim 7, wherein the lip includes a first step and at least one subsequent step, the first step having a larger depth and smaller protruding length than each of the subsequent steps.

9. The wall block of claim 1, further including a connecting structure for connecting a secondary structure to the rear face of the rear portion.

10. The wall block of claim 1, wherein the three-dimensional surface structure of the front face includes at least one false joint.

11. The wall block of claim 10, wherein the false joint is oriented at an angle of 0 to 45 degrees to the top or bottom face.

12. The wall block of claim 11, wherein the irregular peripheral edge of the front face includes a top edge and a bottom edge respectively oriented towards like blocks stackable above or below the wall block and lateral edges oriented towards like blocks stackable side by side with the wall block, at least one of the lateral edges being oriented at an angle of 45 to 90 degrees to the top or bottom edge.

13. The wall block of claim 12, wherein the parallel planar side walls of the rear portion are oriented at an angle of 70 to 110 degrees to the bottom face.

* * * * *